United States Patent [19]

Brewer

[11] Patent Number: 4,966,633

[45] Date of Patent: Oct. 30, 1990

[54] COERCIVITY IN HOT WORKED IRON-NEODYMIUM BORON TYPE PERMANENT MAGNETS

[75] Inventor: Earl G. Brewer, Warren, Mich.

[73] Assignee: General Motors Corporation, Detroit, Mich.

[21] Appl. No.: 371,186

[22] Filed: Jun. 26, 1989

[51] Int. Cl.[5] ..... H01F 1/04

[52] U.S. Cl. ..... 148/101; 148/121

[58] Field of Search ..... 148/100, 101, 102, 103, 148/120, 121, 122

[56] References Cited

U.S. PATENT DOCUMENTS

| | | | |
|---|---|---|---|
| 4,792,367 | 12/1988 | Lee | 148/104 |
| 4,802,931 | 2/1989 | Croat | 148/302 |

FOREIGN PATENT DOCUMENTS

| | | | |
|---|---|---|---|
| 0153744 | 9/1985 | European Pat. Off. | 148/103 |
| 62-119903 | 6/1987 | Japan | 148/101 |
| 62-165305 | 7/1987 | Japan | 148/102 |

*Primary Examiner*—John P. Sheehan

*Attorney, Agent, or Firm*—George A. Grove

[57] ABSTRACT

The coercivity of fine grain, hot worked $RE_2TM_{14}B$ type permanent magnets is improved by quenching the material from a temperature greater than about 500° C. to below about 100° C.

7 Claims, 2 Drawing Sheets

COERCIVITY IN HOT WORKED IRON-NEODYMIUM BORON TYPE PERMANENT MAGNETS

This invention pertains to a method of heat treating fine grained anisotropic permanent magnets of the iron-neodymium-boron type compositions so as to improve the coercivity of the magnet without a concomitant reduction in its remanent magnetization or energy product. More specifically, this invention pertains to the rapid cooling of such compositions from a hot working temperature so as to increase the magnetic coercivity.

BACKGROUND OF THE INVENTION

Lee, U.S. Pat. No. 4,792,367, issued Dec. 20, 1988, demonstrated that very fine grained compositions of certain transition metals including iron, rare earth elements including neodymium and/or praseodymium, and relatively small amounts of boron can be suitably hot worked to form very strong anisotropic permanent magnets. Lee's process is applicable to compositions of the type disclosed by Croat in U.S. Pat. No. 4,802,931 issued Feb. 7, 1989.

Croat disclosed permanent magnet compositions containing as the essential magnetic phase very small grains of tetragonal crystals of $RE_2TM_{14}B$ where RE is one or more rare earth elements including neodymium and/or praseodymium, and TM is preferably iron or mixtures of iron and cobalt. While $RE_2TM_{14}B$ (for example, $Nd_2Fe_{14}B$ is the essential and predominant phase, preferred compositions also contain a relatively small amount of one or more grain boundary phases containing rare earth elements and transition elements and sometimes boron. Typically, the grain boundary phase is richer in rare earth element content than the principal phase. The grain boundary phase which surrounds the larger grains of the $RE_2TM_{14}B$ phase is believed to provide magnetic coercivity in such material by pinning the magnetic domain walls formed in the larger grains when the material is placed in a magnetic field. In general, suitable overall compositions for the preparation of such permanent magnets comprise in terms of atomic percentage about 50 to 90 percent transition metal, about 10 to 40 percent rare earth metal and at least 0.5 percent boron.

Alloys of such composition were melted and very rapidly solidified such as, for example, by melt spinning to produce a fine grain microstructure. The material was processed to obtain a material in which the average grain size of the principal phase was in the range of 20 to 300 nanometers. Materials of such microstructure could be obtained either directly upon melt spinning or by a practice of overquenching to an amorphous material and annealing to obtain the desired grain size. These practices are disclosed in the above-identified Croat patent.

The Croat-type compositions had appreciable coercivity and in general were magnetically isotropic. The melt-spun or melt-spun and annealed particles could be pulverized if desired into a powder of average size of a few microns to 350 microns. The powder could be consolidated with a suitable resin to form a unitary magnet body having no preferred direction of magnetization. Such magnet materials have many useful applications. However, their maximum magnetic properties are not appropriate for applications in which higher strength anisotropic magnets would better serve.

Lee's patent describes the hot pressing of the Croat magnetically isotropic powder to form a full density magnetic body that was generally isotropic but displayed some magnetic anisotropy in the direction in which the particles were pressed. However, Lee found that upon further hot working of his original hot pressed compact, even stronger, more definitely anisotropic permanent magnets could be formed. Further development of the Lee practice has centered on the hot working techniques for the iron-neodymium-boron type materials so as to achieve ever more complete alignment of the 2-14-1 grains and greater anisotropy and magnetic properties. The term "2-14-1" is a shorthand reference to $RE_2TM_{14}B$ grains or to compositions containing or based upon such a tetragonal crystalline phase.

I have found a method of heat treatment of a hot worked 2-14-1 type permanent magnet so as to significantly improve its intrinsic coercivity, Hci (usually in kiloOersteds, kOe). My practice will improve the coercivity of the hot worked material without any reduction in the residual magnetization, Br. This usually results in an increase in the energy product of the magnet. Thus, my practice may be applied to improve the coercivity of any hot worked anisotropic, fine grained permanent magnet of the 2-14-1 type.

BRIEF SUMMARY OF THE INVENTION

In accordance with a preferred embodiment of my invention, these and other objects of my invention are accomplished as follows.

In the hot pressing and hot working of fine grained 2-14-1 magnets, such thermomechanical treatment is carried out at a suitable elevated temperature preferably over 700° C. for a time sufficient to obtain full densification of the material, the formation of a suitable fine grain microstructure and substantial plastic deformation so as to align the preferred magnetization direction of as many of the grains as possible. Hot working tends to flatten the grains perpendicular to the direction of material flow. Furthermore, the processing is controlled so that the average major dimension of the flattened grains is below about 500 to 1000 nanometers. In accordance with my process, the coercivity improvement is achieved by quenching the hot worked sample from its hot work temperature to a temperature below about 100° C. The hot worked magnet may be quenched in water, a suitable aqueous solution or a nonaqueous quenchant provided that the magnet is cooled to below 100° C. within about one or two seconds. If it is inconvenient to quench the hot worked permanent magnet at the end of the hot working operation, the magnet may be slowly cooled in a nonoxidizing atmosphere and subsequently reheated and quenched to obtain a beneficial increase in coercivity. Where the hot worked magnet is reheated, it is preferably reheated to a temperature above 500° C. and preferably a temperature in the range of about 625° C. to 800° C.

DESCRIPTION OF THE DRAWINGS

Other advantages of my invention will be better appreciated from a detailed description of its practice. During the description, reference will be had to the drawings in which.

DETAILED DESCRIPTION OF THE INVENTION

Figure 1:
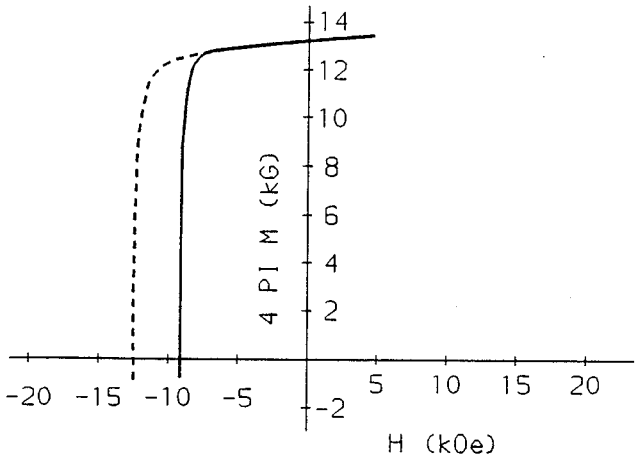
FIG. 1 comprises demagnetization curves illustrating an increase in Hci after quenching directly from the die upset process temperature of 750° C. (dotted line) compared to the coercivity of a standard slow-cooled die upset magnet (solid line)

In the following examples, alloys of the specified compositions were prepared by induction melting a mixture of the individual constituents under argon in an alumina vessel. The alloy was then remelted by induction heating under argon atmosphere and ejected from an alumina lined vessel through a 0.032 inch diameter orifice onto the rim of a rotating metal substrate quench wheel. The wheel was water cooled. The samples were melt spun in an argon atmosphere with a wheel rim speed of about 35 meters per second. The molten alloys were converted by this melt spinning practice to ribbon fragments a few microns thick and about 10 millimeters wide.

The quench rate of all samples used herein was such that the material was generally amorphous in its microstructure. Insofar as obtaining optimum permanent magnet properties in accordance with the above-identified Croat patent is concerned, the material was overquenched. It was amorphous in microstructure or of a grain size too small to display significant coercivity. However, subsequent hot pressing and hot working operations will produce sufficient grain growth for permanent magnet properties.

The material was pulverized to particles of 45 to 250 micrometers.

In each of the following examples, a portion of the specific melt-spun composition was placed in a die heated to 750° C. The material was allowed to come to the temperature of the die over a period of about 1½ minutes and then pressed at 750° C. and a pressure of 15,000 psi (103.4 MPa). A fully densified body in the form of a right cylinder 0.4 inches in diameter and 0.4 inches thick was formed. The total processing time was about two minutes. The hot pressed products have generally spherical grains about 50 nanometers in diameter. These hot pressed, fully densified samples were the starting materials for the following examples.

EXAMPLE 1

Two hot pressed samples of composition $Nd_{0.13}(Fe_{0.94}B_{0.06})_{0.87}$ were prepared as described above. The samples were believed to be substantially identical in their processing history and magnetic properties. The first sample was placed in a heated die of 0.625 inch diameter. The sample was heated in the die to 750° C. and die upset to form a fully dense, hot worked (by die upsetting) pancake-like cylindrical body 0.625 inch in diameter and 0.2 inch thick. The total processing time was about two minutes. The sample was removed from the die and allowed to cool slowly on a cold metal plate in a vacuum (Sample 1). The second hot pressed sample was hot die upset in the same manner and then water quenched (Sample 2). Sample 1 and Sample 2 were sectioned with a diamond chip-coated saw to obtain a 0.050 gram cube from each for the purpose of measuring the magnetic properties of each sample. Magnetic measurements were performed on each of Sample 1 and Sample 2 using a vibrating sample magnetometer (VSM). The properties of the samples were as follows.

| Cube | Br (KG) | Hci (KOe) | E.P. (MGOe) |
|---|---|---|---|
| Sample 1 | 13.2 | 9.1 | 40.9 |
| Sample 2 | 13.2 | 12.3 | 40.8 |

It is seen that the water-quenched Sample 2 has a much higher intrinsic coercivity as compared to the slow-cooled Sample 1. The magnetic remanence of the samples are unchanged, and in this instance the maximum energy products were approximately the same.

In order to confirm the effect of quenching on Sample 2, the Sample 2 cube was annealed at 750° C. in argon for two minutes and then allowed to furnace cool. After annealing, the magnetic properties were measured in the VSM and found to be as follows: Br=13.2 kG, Hci=9.6 kOe and energy product=39.5 MGOe. It is seen that the annealing and slow cooling removed the effect of the quenching as regards the improvement in coercivity. The remanent magnetization and the energy product were substantially unchanged.

The Sample 2 cube was again annealed for two minutes at 750° C. in argon. This time, it was quenched in water. Magnetic properties were then found to Br=13.2 kG, Hci=12.9 kOe and energy product=40.4 MGOe.

It is seen that the process is reversible and that the rapid cooling from 750° C. produces a marked improvement in coercivity without any adverse effect on other magnetic properties. In order to further demonstrate the efficacy of this rapid cooling practice, the Sample 1 cube was annealed for two minutes at 750° C. under argon and quenched in water at ambient temperature. The magnetic properties following quenching were Br=13.3 kG, Hci=12.5 kOe and energy product=41.4 MGOe. Thus, although the original hot die upset, slow cooled sample had good magnetic properties when processed in the traditional manner, the coercivity of the sample was markedly improved when it was reheated quickly to its hot working temperature and water cooled.

EXAMPLE 2

A number of hot pressed, fully dense samples of the composition $Nd_{0.13}(Fe_{0.94}B_{0.06})_{0.87}$ were die upset as described in Example 1. Each sample was quenched into water directly after the die upsetting operation under argon. Each flattened cylindrical sample was sectioned to remove a 0.050 gram cube from the central section of the hot die upset body. The magnetic properties of each cube were measured in a vibrating sample magnetometer. They had nearly identical demagnetization curves. A typical curve is illustrated in FIG. 1 with the dotted line demagnetization curve depicting the properties of the sample quenched directly from the hot work temperature of 750° C. At the point in the curve at which the sample experienced zero applied magnetic field, it is seen that it then retained a magnetization of about 13.2 kG. This value is termed the remanence Br; or remanent magnetization of the sample. The coercivity of the sample, i.e. the strength of reverse magnetic field increasing to reduce the sample magnetization to zero, was 12.2 kOe.

A first cube was reheated to 750° C., held for five minutes at that temperature in an argon atmosphere and then allowed to slow cool at 50° C. per minute under argon. The demagnetization curve was remeasured, and its demagnetization curve is depicted in FIG. 1 as the solid line. This slow-cooled sample represents properties typically obtained from the standard die upset practice where the workpiece is slowly cooled as it comes off the press. It is seen that both samples have substantially identical values for Br but that the coercivity of the quenched sample is markedly greater than the coercivity (9.0 kOe) of the standard die upset sample.

Figure 2:
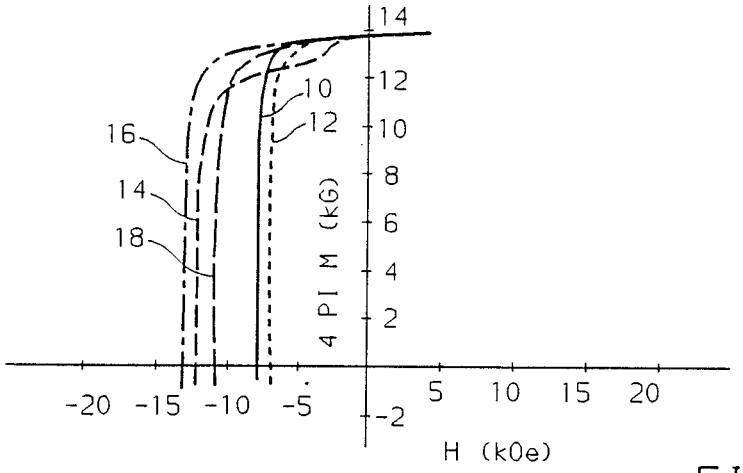
FIG. 2 comprises demagnetization curves for a group of like hot worked specimens quenched after annealing five minutes at the indicated temperatures.

A group of other 0.050 gram cubes was prepared from several die upset, slow-cooled samples for a series of comparative experiments. The cubes had initial demagnetization curves like the solid line curve 10 in FIG. 2. Individual cubes were then heated in argon to temperatures of 400° C. to 800° C. in 50° C. steps with 25° C. steps between 600° C. and 700° C. The respective cubes were annealed at the temperature selected for them for five minutes and then quenched in water to ambient temperature. FIG. 2 is a compilation of demagnetization curves for selected cubes quenched after annealing five minutes at the indicated temperatures.

FIG. 2 illustrates that all of the samples possessed the same value of Br. Curve 10 is the demagnetization curve for the die upset sample cooled in argon from its die upset temperature. The Hci for that sample is about 7.8 kOe. Curve 12 is the demagnetization sample for the sample annealed at 400° C. and water quenched. Its Hci decreased to about 6.9 kOe. The 625° C. anneal and quenched sample (Curve 14) displayed a Hci of about 10.8 kOe. The 700° C. anneal and quenched sample (Curve 16) displayed a Hci of 13.2 kOe. The 800° C. anneal and quenched sample (Curve 18) displayed a Hci value of about 10.8 kOe.

Figure 3:
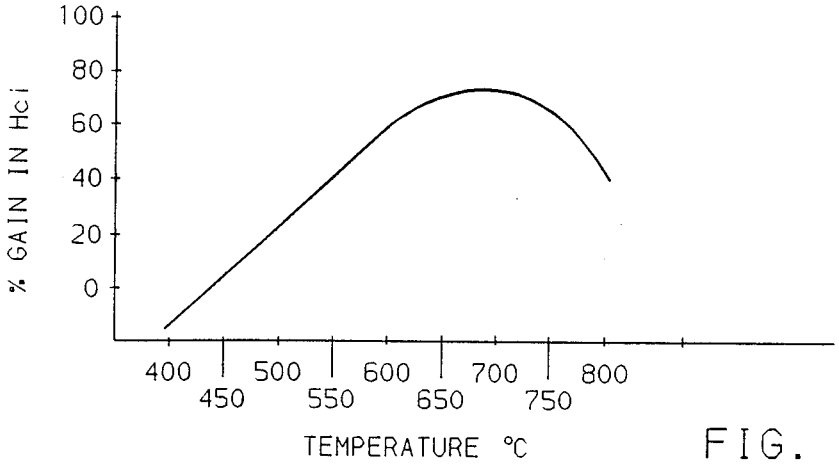
FIG. 3 is a plot of percent increase in Hci on quenching from various temperatures.

FIG. 3 is a plot of percent gain in Hci obtained on quenching from various annealing temperatures of the original 0.050 cubes. This plot contains and compliments the data of FIG. 2. It is seen that the heating of the cube to a temperature of about 500° C. or more up to 800° C. resulted in some improvement in the coercivity of the sample. This improvement was obtained without a concomitant reduction in other magnetic properties. However, as seen in FIG. 3, best results were obtained when the cube was quenched from a temperature of about 650° C. to 750° C.

It has been found that prolonged aging of quenched specimens for 60° C. in air for 30 days does not change the values of Hci obtained by the practice of this process.

I have found that my quench practice may be successfully employed using a variety of quench media. The greatest improvements in coercivity values are obtained using water or a rapid quench oil such as a silicone oil. However, other quench media such as mineral oil or five percent aqueous sodium hydroxide solution or the like may be employed. Still (unagitated) water has a quench rate of approximately 2700° C. per second whereas air has a quench rate of only about three percent of that rate. It appears that quenchants capable of providing at least about 25 percent of that of still water would be suitable for the practice of this invention.

It is apparent from the several examples above that the benefits of my invention may be obtained either by the quenching of the workpiece directly following the hot working operation. However, if the environment or timing of the hot working operation is not conducive to the quenching of the workpiece at that time, it may be initially cooled in any available manner. Thereafter, the workpiece may be reheated to a temperature above about 500° C. and then quenched to obtain the increase in coercivity.

Figure 4A:
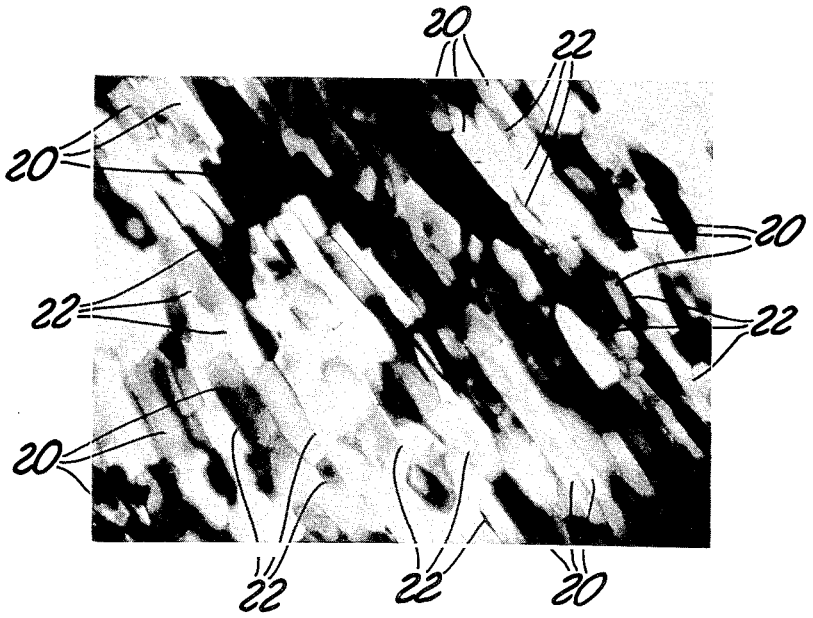
FIG. 4*a* is a photomicrograph (100,000×) of the microstructure of a die upset neodymium-iron-boron magnet sectioned parallel to the press direction showing flat $Nd_2Fe_{14}B$ grains as well as an intergranular phase.
Figure 4B:
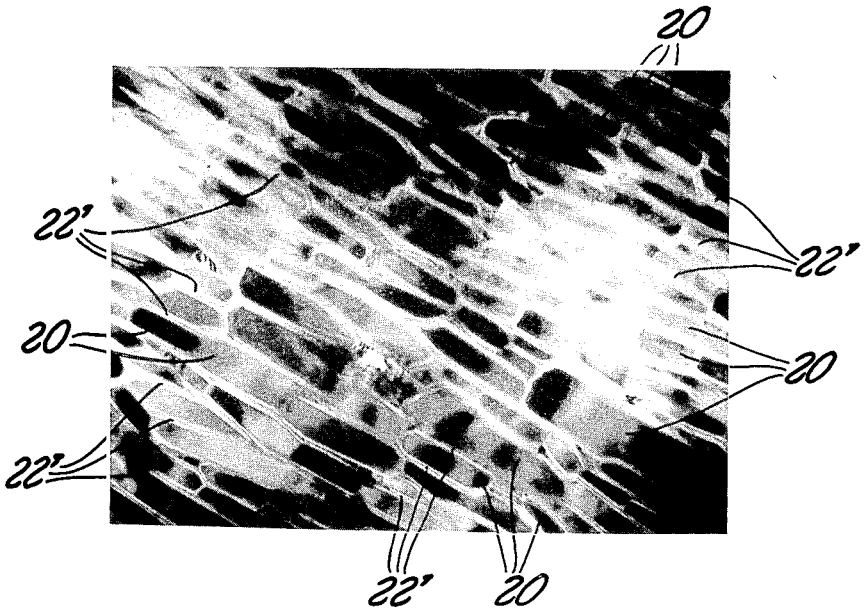
FIG. 4*b* is a photomicrograph (100,000×) depicting the microstructure of a like die upset magnet annealed five minutes at 750° C. and quenched into water.

It appears that the effect of my process is to increase the volume of the grain boundary phase. As indicated above, this phase is believed to be neodymium rich, compared to the 2-14-1 phase. This is illustrated by a comparison of the two photographs in FIG. 4. FIG. 4*a* illustrates the microstructure of a die upset, but slow cooled neodymium-iron-boron magnet sectioned parallel to the press direction. This photograph shows the flattened $Nd_2Fe_{14}B$ grains 20 as well as a barely perceptible amount of an intergranular face-centered cubic phase 22. The 2-14-1 grains are seen to be generally less than 500 nm in their long dimension and about 50 nm thick. Thus, the hot pressing and hot die upsetting processes have converted the generally amorphous melt-spun starting material to a fine deformed grain product. FIG. 4*b* is a like photomicrograph of a like die upset composition which has been quenched from the hot working temperature. In this photograph the intergranular phase 22' is much more prominent. The flattened $Nd_2Fe_{14}B$ grams 20 are substantially the same as the like grams in FIG. 4(*a*).

Thus, it appears that the temperatures above about 500° C. and especially at temperatures of 650° C. to 800° C., an equilibrium exists in which there is more of the grain boundary phase (22, 22'). Quenching preserves the microstructure with this greater abundance of the grain boundary phase whereas slow cooling permits a portion of it to dissipate. The grain boundary phase is known to play an essential role in providing the magnetically coercive properties of these magnets. Thus, the increased amount of the phase apparently contributed to the increased coercivity of these permanent magnets.

In the specifications, the term hot working has been used to describe the plastic deformation at suitable elevated temperatures of fine grained compositions consisting initially of iron, neodymium and/or praseodymium and boron. The intent and effect of the hot working is to deform and align the crystals or grains of the 2-14-1 phase so that the material becomes magnetically anisotropic. That is, a body of the material displays a preferred direction of magnetization. Hot working may be carried out by any suitable practice such as, e.g. die upsetting, extrusion, rolling, forging, hot isostatic working or the like.

It has previously been recognized that hot worked, deformed fine grain 2-14-1 type anisotropic permanent magnet bodies can be comminuted to make a magnetically anisotropic powder. It is recognized that the subject anneal and quench practice could be applied to such powder rather than to the hot worked body from which the powder is made. However, in general, it will be preferred to apply the subject process to hot worked bodies rather than powder because of the sensitivity of the rare earth element-containing powder to oxidation or other contamination by many quenchant materials.

Certain preferred compositions amenable to the practice of this invention have been disclosed. To better summarize, my invention may be practiced on permanent magnet compositions in which the predominant constituent is the tetragonal crystal phase of $RE_2TM_{14}B$. RE can be any rare earth element, but 60% or more of the rare earth content of the magnet shall consist of neodymium and/or praseodymium. Frequently cerium, lanthanum, and samarium and yttrium are present in commercial sources of neodymium and praseodymium. TM is principally iron and cobalt. Outer metals may be present in minor amounts or as impurities. These include metals such as W, Cr, Ni, Al, Cu, Mn, Mg, Ga, Nb, V, Mo, Ti, Zr and Ca. Si is usually present in small amounts as are $O_2$ and $N_2$.

It is recognized that the coercivity of a particular hot worked, fine grain, 2-14-1 type permanent magnet may vary considerably depending, e.g., upon its specific composition, its hot working practice and history and even the rapid solidification process by which its precursor material was prepared. Thus, some conventionally processed (i.e., slow cooled) hot worked magnets may display relatively high initial coercivities. However, in general, the subject practice of quenching the hot worked body from an elevated temperature will further increase its coercivity.

While my invention has been described in terms of a specific embodiment thereof, it will be appreciated that other compositions could be readily adapted by one skilled in the art. Accordingly, the scope of my invention is to be considered limited only by the following claims.

The embodiments of the invention in which an exclusive property or privilege is claimed are defined as follows:

1. A method of increasing coercivity in a hot worked, rapidly solidified material consisting essentially of a predominant phase of hot work deformed fine grains of $RE_2TM_{14}B$ and at least one coercivity contributing intergranular phase, said deformed fine grains contributing magnetic anisotropy to the hot worked material, said method comprising quenching the material to below 100° C. from an elevated temperature at which the equilibrium quantity of such intergranular phase is substantially greater than its equilibrium quantity below 100° C.

2. A method of increasing coercivity in a hot worked, rapidly solidified material consisting essentially of a predominant phase of hot work deformed fine grains of $RE_2TM_{14}B$ and at least one coercivity contributing intergranular phase, said deformed fine grains contributing magnetic anisotropy to the hot worked material, said method comprising quenching the material from a temperature above about 500° C. to below about 100° C.

3. A method of increasing coercivity without concomitant loss of magnetic remanence in hot worked bodies of rapidly solidified fine grained permanent magnet compositions consisting essentially of a predominant phase of hot work deformed crystallographically aligned grains of $RE_2TM_{14}B$ and coercivity inducing intergranular phase, said deformed fine grains contributing magnetic anisotropy to the hot worked material, said method comprising quenching the hot worked body from a temperature in the range of about 500° C. to 800° C. into a rapid cooling medium to a temperature below about 100° C.

4. A method of increasing coercivity in a hot worked, rapidly solidified material consisting essentially of a predominant phase of hot work deformed fine grains of $RE_2TM_{14}B$ and at least one coercivity contributing intergranular phase, said deformed fine grains contributing magnetic anisotropy to the hot worked material, said method comprising heating the material to an elevated temperature to increase the quantity of said intergranular phase and quenching the material to retain the increased quantity.

5. A method of increasing coercivity in a hot worked, rapidly solidified material consisting essentially of a predominant phase of hot work deformed fine grains of $RE_2TM_{14}B$ and at least one coercivity contributing intergranular phase, said deformed fine grains contributing magnetic anisotropy to the hot worked material, said method comprising heating the material to a temperature above about 500° C. for a period of minutes and quenching to a temperature below about 100° C.

6. A method of increasing coercivity in a hot worked, rapidly solidified material consisting essentially of a predominant phase of hot work deformed fine grains of $RE_2TM_{14}B$ and at least one coercivity contributing intergranular phase, said deformed fine grains contributing magnetic anisotropy to the hot worked material, said method comprising heating the material to a temperature in the range of about 500° C. to 800° C. and quenching below about 100° C.

7. A method of increasing coercivity in a hot worked, rapidly solidified material consisting essentially of a predominant phase of hot work flattened fine grains of $RE_2TM_{14}B$, the average largest dimension of such grains not exceeding 1000 nm, and at least one coercivity contributing intergranular phase, said flattened fine grains contributing magnetic anisotropy to the hot worked material, said method comprising quenching the material to below 100° C. from an elevated temperature at which the equilibrium quantity of such intergranular phase is substantially greater than its equilibrium quantity below 100° C.

* * * * *